US005852942A

United States Patent [19]

Sharp et al.

[11] Patent Number: 5,852,942

[45] Date of Patent: Dec. 29, 1998

[54] AUTOMATIC WASHER AND TUB THEREFOR

[75] Inventors: Brenner M. Sharp, St. Joseph, Mich.; Jean-Paul D. Merlin, Saveuse, France

[73] Assignee: Whirlpool Corporation, Benton Harbor, Mich.

[21] Appl. No.: 707,789

[22] Filed: Sep. 4, 1996

Related U.S. Application Data

[60] Provisional application No. 60/004,544 Sep. 29, 1995.

[51] Int. Cl. [6] ..... D06F 1/10

[52] U.S. Cl. ..... 68/3 R; 68/139

[58] Field of Search ..... 68/3 R, 19.2, 20, 68/24, 58, 139, 140, 142

[56] References Cited

U.S. PATENT DOCUMENTS

| | | | |
|---|---|---|---|
| 2,083,503 | 6/1937 | Nelson | 68/3 R |
| 2,309,617 | 1/1943 | Benson | 68/3 R |
| 2,631,447 | 3/1953 | Eilersgaard | 68/140 |
| 2,807,963 | 10/1957 | Osterhus et al. | 74/177 |
| 2,968,174 | 1/1961 | Bell et al. | 68/24 |
| 3,060,764 | 10/1962 | Sibbald | 74/665 |
| 5,050,754 | 9/1991 | Marino | 215/256 |
| 5,570,598 | 11/1996 | Haven | 68/235 D |
| 5,711,170 | 1/1998 | Johnson | 68/3 R |

FOREIGN PATENT DOCUMENTS

| | | | |
|---|---|---|---|
| 79.180 | 9/1962 | France . | |
| 2564492 | 11/1985 | France | D06F 37/00 |
| 1610072 | 1/1971 | Germany . | |
| 2508849 | 2/1976 | Germany | D06F 37/26 |
| 4235003 | 10/1992 | Germany | D06F 37/26 |
| 659607 | 1/1964 | Italy | 134/159 |

*Primary Examiner*—Frankie L. Stinson
*Attorney, Agent, or Firm*—Robert O. Rice; Joel M. Van Winkle; Thomas A. Schwyn

[57] ABSTRACT

The invention is an appliance, such as an automatic washer, having a tub in which a wash basket is mounted. The tub comprises an upper and a lower tub member, which are connected by an interference connection. The interference connection is formed by one of the tub members being provided with a peripheral channel and the other tub member being provided with a flange adapted to be received within the channel. Multiple protrusions can extend from one or both of the flange or channel side walls to abut and deflect the flange to form the interference connection.

23 Claims, 4 Drawing Sheets

52
55
53
66
62
60
56
58
T
W 4
65
59
60

AUTOMATIC WASHER AND TUB THEREFOR

BACKGROUND OF THE INVENTION

1. Field of the Invention

This application claims the benefit of U.S. Provisional Application No. 60/004,544 filed Sep. 29, 1995.

The invention relates to an automatic washer, and more specifically, to a tub for an automatic washer.

2. Description of the Related Art

Automatic clothes washers are generally vertical axis washers or horizontal axis washers. Both categories of washers have an imperforate tub in which a perforated wash basket is mounted for rotation relative to the tub. In the vertical axis washers, the basket rotates about a vertical axis. Likewise, in a horizontal axis washer, the basket rotates about a horizontal axis. Typically, horizontal axis automatic washers employ either a front-loading or a top-loading configuration for receiving clothes items to be washed. U.S. Pat. No. 3,197,980 to Marple, issued to the assignee of the present invention, shows a typical front-loading, horizontal axis washer wherein a horizontally oriented wash basket is accessed through one of the vertical end walls of the basket and the front surface of the washer.

The preference of many consumers, however, particularly those in the United States, is for top-loading washers. For these types of top-loading horizontal axis washers, it is known to form a tub from two pieces—an upper tub member and a lower tub member. French Pat. No. 79,180, for example, discloses a horizontal washer having a tub including an upper tub member and a lower tub member.

As can be readily understood by one skilled in the art, it is desirable to have a connection between the tub members wherein their quick and economical joining is accomplished. The prior art suggests several systems for joining tub members. U.S. Pat. No. 3,060,764, issued Oct. 30, 1962, discloses an inclined-axis washer having a two-piece metallic tub wherein the two pieces of the tub are secured together using a plurality of clamps. U.S. Pat. No. 2,807,963, issued Oct. 1, 1957, discloses an inclined-axis washer having a two-piece metallic tub wherein a seal is provided between opposing radial flanges extending from the respective tub pieces and an annular, V-shaped band clamps together the tub pieces.

One disadvantage of separate fasteners is that they increase the complexity and difficulty of assembling the tub. Also, as is well known, additional parts typically increase the cost of manufacturing. Another disadvantage of previous designs is that they do not provide for the simple positioning and alignment of the tub members relative to each other prior to securing together the tub members. Furthermore, as is well known by those skilled in the art, in the formation of large plastic parts, size variations and warpage may occur. These size variations and warpage must be accommodated when joining plastic tub members. The previous tub member connections do not address these problems. There exists, therefore, a need to easily and quickly secure tub members together in such a way to accommodate any dimensional variation and warpage in the tub members.

SUMMARY OF THE INVENTION

The invention is directed to an automatic washer and a tub therefor in which the tub can be quickly and simply assembled and simultaneously accommodate variations in the dimensions of the tub members. In the preferred embodiment, the invention is directed to an automatic washer having a wash tub that defines a chamber adapted to receive a wash basket. The wash tub comprises an upper tub member and a lower tub member. The upper tub member has an upper peripheral rim. Likewise, the lower tub member has a second peripheral rim. The upper and lower tub members are connected to form the tub by an interference connection between at least a portion of the upper and second peripheral rims.

Preferably, the upper peripheral rim is provided with opposing side walls connected by a transverse wall to define a U-shaped channel. The second peripheral rim is provided with a flange having opposing sides corresponding to the side walls of the upper peripheral rim. The channel and flange are sized accordingly so the flange can be received in the channel.

A protrusion, such as an integrally-formed rib, extends from at least one of the sides of the flange a sufficient distance to abut one of the side walls of the U-shaped channel, thereby providing an interference connection between the upper tub member and the lower tub member. Preferably, there are multiple protrusions alternately disposed on the opposing sides of the flange. Alternatively, the protrusions can be formed on the side walls of the U-shaped channel instead of the sides of the flange.

The upper tub member and the lower tub member are preferably made from a resiliently flexible material so that when the flange abuts at least one of the side walls of the U-shaped channel, the flange is resiliently flexed, imparting a force against the side walls of the U-shaped channel, to form the interference connection between the upper tub member and the lower tub member. The upper and lower tub members are further secured together by a flexible tab having an engagement slot and provided on either the upper or lower tub member and an engagement hook corresponding to the flexible tab provided on the other of the upper tub member and lower tub member so that when the upper and lower tub members are connected by the interference connection, the engagement hook is received within the engagement slot, further securing the upper tub member to the lower tub member.

In another embodiment, the invention is a tub for an appliance—the tub comprising an upper tub member having a pan-like body with a first peripheral rim and a lower tub member having a pan-like body with a second peripheral rim. The upper and lower tub members are connected together by an interference connection between at least a portion of the upper and second peripheral rims.

DESCRIPTION OF PREFERRED EMBODIMENTS

Figure 1:
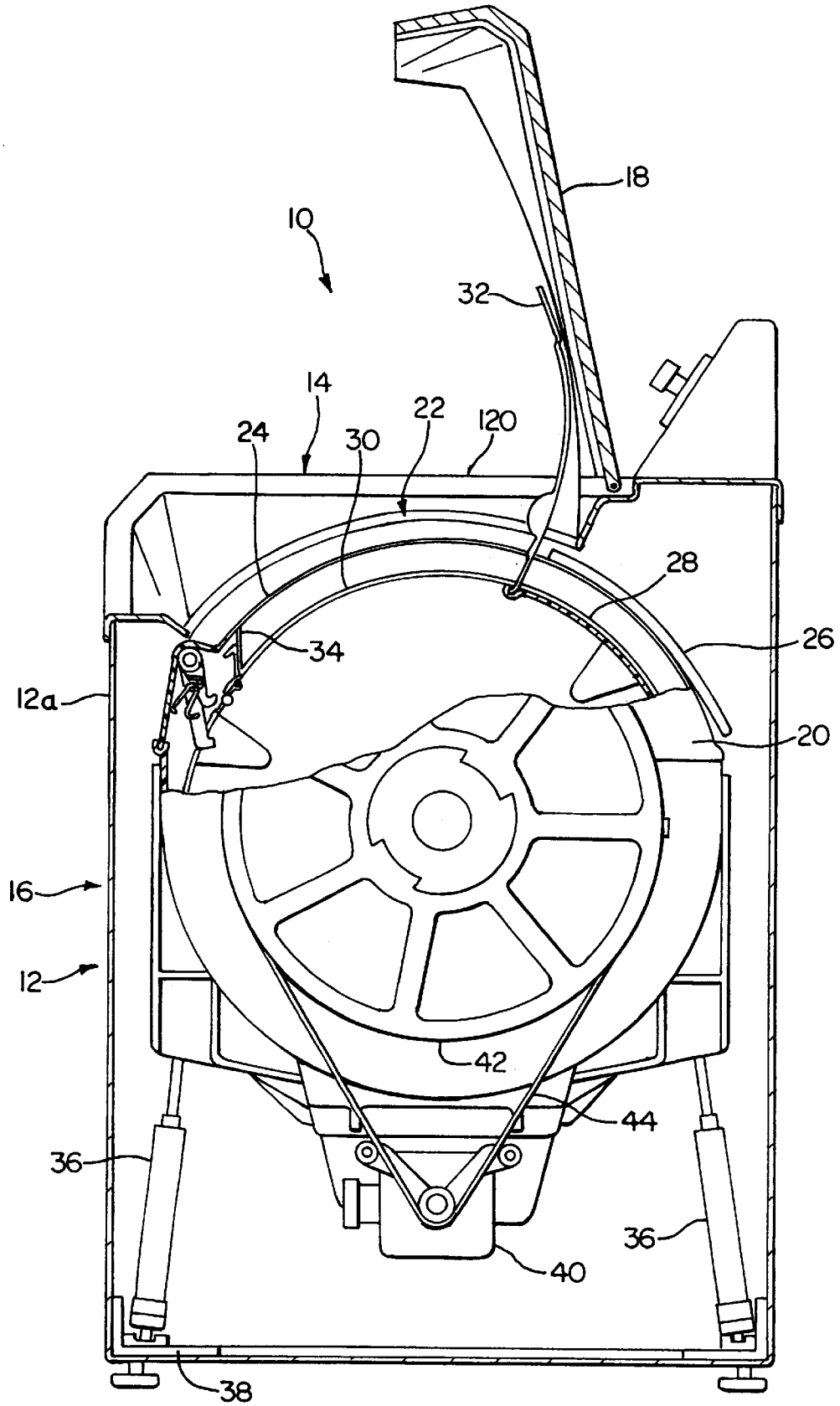
FIG. 1 is a partially cut-away side elevational view of an automatic washer embodying the present invention.

Referring to the drawings and specifically to FIG. 1, there is illustrated a top-loading drum-type automatic washer 10 embodying the present invention. The washer 10 has an enclosure 12 including a top member 14, an outer cabinet 16 and an openable lid 18, shown in an open position, which encloses an imperforate wash tub 20. The top member 14 includes an access opening 22 extending partially along a top surface 12*e* and a front surface 12*a* for accessing the interior of the enclosure 12.

The wash tub 20 has an upwardly-orientated rectangular tub opening 24. The opening 24 is aligned with the access opening 22 and a slidable wash tub lid 26, shown in an open position, is provided for sealably closing the opening 24.

Disposed within the wash tub 20 is a rotatable, perforate wash basket 28 having a rectangular basket opening 30 provided with an openable first door flap 32 and an openable second door flap 34. The door flaps 32, 34 shown in an open position, may be aligned with the tub opening 24 to permit access into the wash basket 28 for the loading and unloading of clothes from the wash basket 28.

The wash tub 20 is supported within the enclosure 12 by struts 36 extending from the tub 20 to a frame 38. A motor 40 is supported from the tub 20 and is drivably connected to a pulley 42 by a belt 44. The pulley 42 is drivably interconnected with the basket 28 such that the motor 40 can rotate the basket 28 within the tub.

The specific structure of the wash basket, enclosure and various control systems for the washer 10 are shown and described in pending U.S. patent application Ser. No. 08/235,999, which is incorporated by reference.

It should be noted that although the invention is illustrated in the context of a top-loading horizontal axis washer, it is contemplated that the invention is also applicable to a top-loading or front-loading vertical axis or horizontal axis washer. It is also contemplated that the invention is applicable to appliances other than automatic washers, such as dishwashers.

Figure 2:
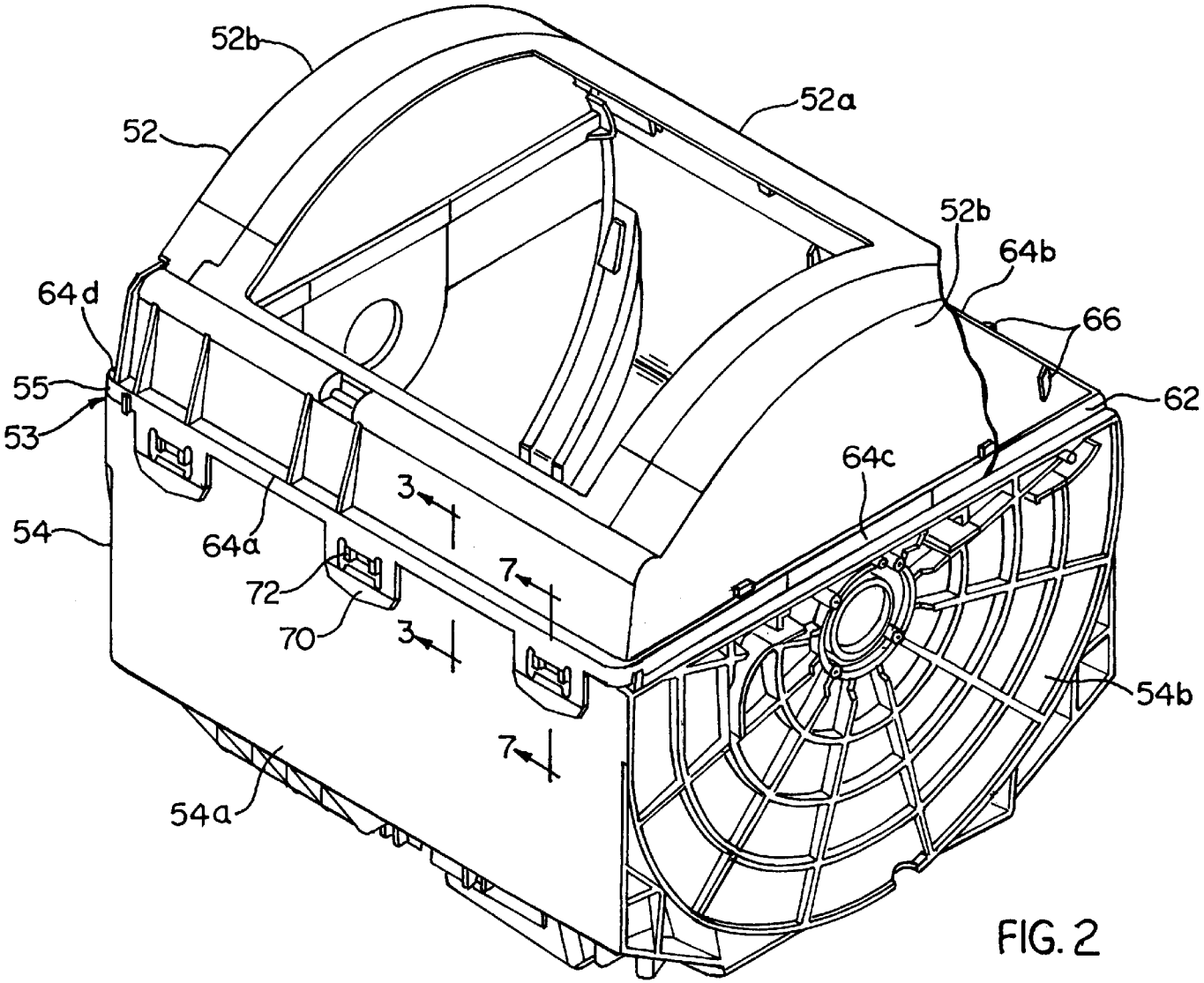
FIG. 2 is a perspective view of a two-piece washer tub having an upper tub member and a lower tub member according to the present invention.
Figures 3, 4:
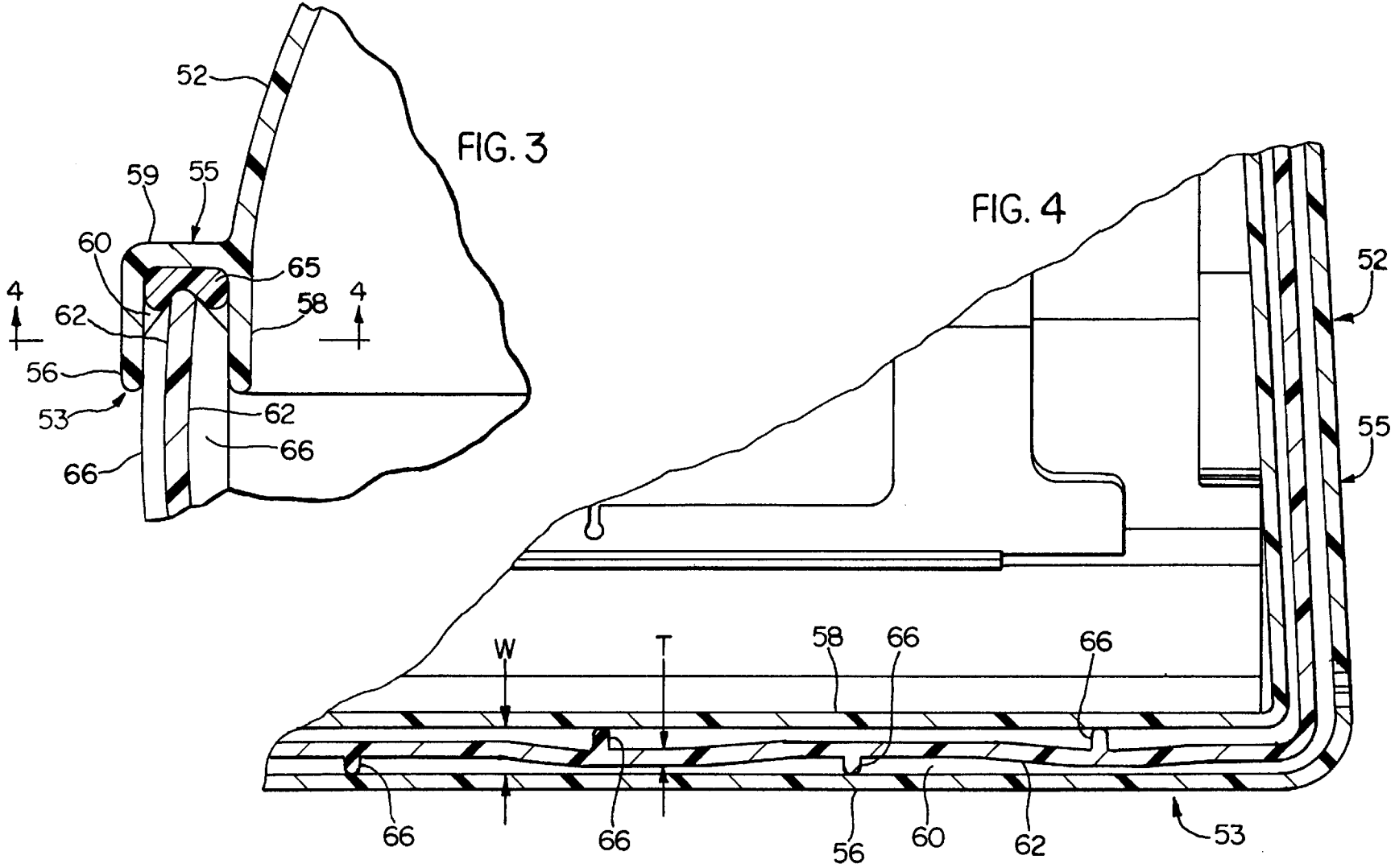
FIG. 3 is a cross-sectional view of an interference connection between the upper tub member and the lower tub member taken along line 3—3 of FIG. 2.
FIG. 4 is a partial sectional plan view, taken along line 4—4 of FIG. 3 of the interference connection between the upper tub member and the lower tub member.

Turning to FIGS. 2–4, various features of the tub 20 are shown in greater detail. The tub 20 comprises an upper tub member 52 and a lower tub member 54, which are joined together by an interference connection 53. Both the upper tub member 52 and the lower tub member 54 are pan-shaped, having exterior walls 52*a*, 54*a* respectively, terminating in opposing end walls 52*b*, 54*b*, respectively. The rectangularly-shaped interference connection 53 can extend about the entire periphery of the upper and lower tub members 52, 54, including along a front edge 64*a*, back edge 64*b*, and side edges 64*c* and 64*d*. However, it is only necessary for the interference connection 53 to extend along at least a portion of the upper and lower tub members 52, 54, preferably, along opposing complementary sides of the upper and lower tub members.

The upper tub member 52 includes a rectangularly-shaped bottom peripheral edge 55, which is formed by a first wall portion 56 and a second wall portion 58 connected by a transverse wall or bight portion 59. The downwardly-extending wall portions 56, 58 and the bight portion 59, define a downwardly-extending or inverted U-shaped channel 60. An elastomeric seal 65 is positioned within the channel 60 to fluidly seal the connection between the upper and lower tub members.

The lower tub member 54 includes an upper peripheral edge 61 (FIG. 3), complementary in shape to the bottom peripheral edge 55 of the upper tub member 52, and has an upwardly-extending flange 62, which is received in the U-shaped channel. Preferably, the U-shaped channel 60 and the flange 62 extend around the entire perimeter of the bottom peripheral edge 55 and the upper peripheral edge 61, respectively.

Multiple protrusions or ribs 66 are integrally formed with the lower tub member 54, extending from the flange 62 along the front and rear edge portions 64*a* and 64*b*. The ribs 66 are positioned in a spaced relationship and extend alternatingly from opposite sides of the flange 62. Although the ribs are illustrated on the front and rear edge portions, it is within the scope of the invention for the ribs to be positioned around the entire perimeter of the flange 62. However, it should be understood that the ribs only need extend along a portion of the flange 62 to perform their function.

As contemplated by the inventors, the upper tub member 52 and the lower tub member 54 are formed from a plastic material, such as filled polypropylene, which is resiliently flexible. As is well known by one skilled in the art of forming large plastic parts, size variations and warpage may occur. The present invention relates to a connection to join the tub members and accommodates any size variation and warpage when the upper and lower tub members are connected to form the tub.

To provide clearance to accommodate the above-described potential size variations and part warpage, the width W of the U-shaped channel 60 is substantially greater than the thickness T of the flange 62 (FIG. 4). Preferably, the width W of the U-shaped channel 60 is at least twice the thickness T of the flange 62. Specifically, the inventors of the present invention contemplate that the width W of the U-shaped channel 60, at the front and rear edges 64*a* and 64*b*, is 10 mm and the thickness T of the flange 62 is 4 mm. In this fashion, regardless of the size variations or warpage, the flange 62 may be readily and easily received into the U-shaped channel 60.

A brief description of the joining of the upper and lower tub members will aid in the understanding of the tub and its connection. The upper tub member 52 and lower tub member 54 are joined by aligning the flange 62 and the channel 60 and inserting the flange 62 into the channel 60. The seal 65 is compressed between the flange 62 and the bight portion 59 to ensure a sealing relationship between the tub members.

Preferably, the ribs 66 extend 4 mm out from the flange 62. As shown in FIG. 4, when the flange 62 is positioned within the U-shaped channel 60, the ribs 66 cause the flange 62 to flex by alternatingly abutting opposite sides of the U-shaped channel 60. In this fashion, the flange 62 is distorted in a serpentine fashion whereby the upper tub member 52 and the lower tub member 54 are interferingly connected by the deflection of the flange 62 and the resiliency of the flange imparting a force against the side walls of the U-shaped channel. The extension of the ribs is sufficient to ensure that the flange is deflected while still maintaining a sufficient difference between the width of the channel and the thickness of the flange to permit the insertion of the flange within the channel while accommodating any variation in the dimensions of the upper and lower tub members. The ends of the ribs 66 are tapered to aid in their insertion within the channel.

Figure 6:
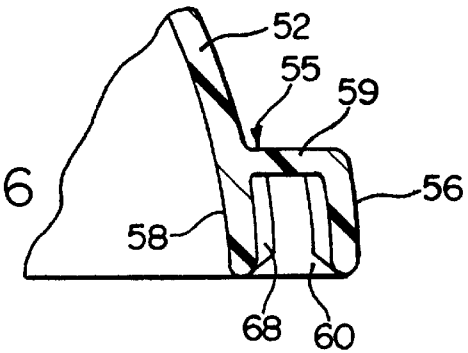
FIG. 6 is a sectional view of the upper tub member taken along line 6—6 of FIG. 5.
Figure 5:
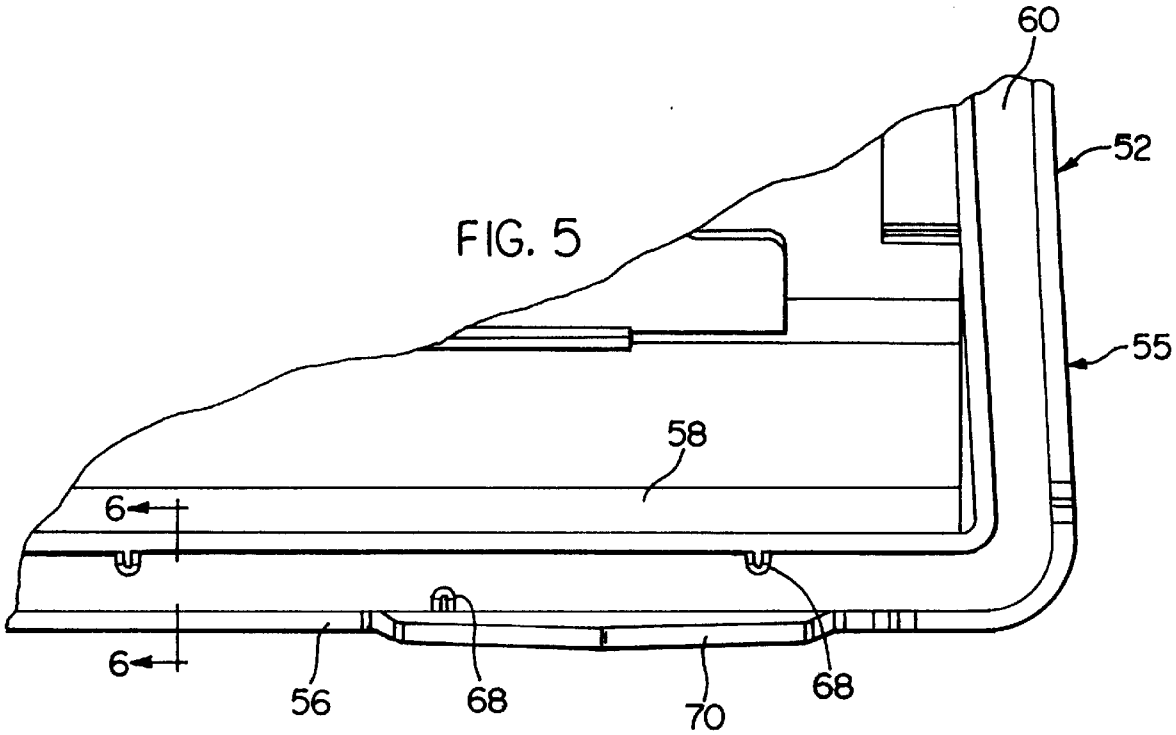
FIG. 5 is a bottom view of a portion of the upper tub member illustrating an alternative embodiment of the invention.

FIGS. 5 and 6 illustrate an alternate location for the ribs, which can be used alone or in combination with the ribs 66 shown in FIGS. 5 and 6. The alternate location places multiple ribs 68 within the U-shaped channel 60 along the front and rear edge portions 64*a* and 64*b,* instead of on the flange 62. The ribs 68 are positioned in a spaced relationship and extend alternatingly from the upper wall portion 56 and the lower wall portion 58 of the U-shaped channels illustrated, no ribs are provided extending from the flange; rather, the ribs 68, extending into the U-shaped channel, engage the flange and cause the flange to distort by alternatingly engaging opposite sides of the flange. Preferably, the ribs 68 extend 4 mm into the U-shaped channel 60. In this fashion, the flange 62 is distorted in a serpentine fashion, in a manner similar to the upper embodiment.

Figure 7:
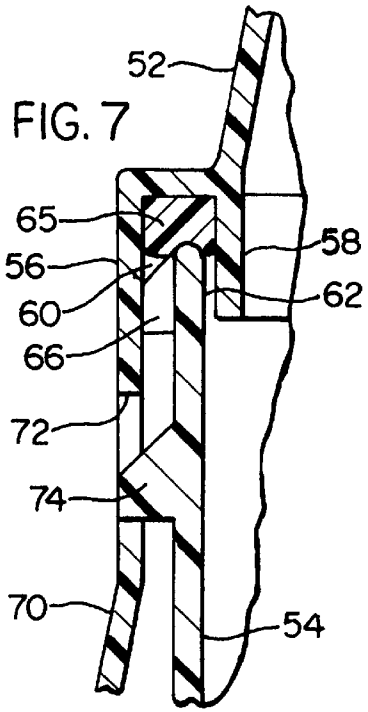
FIG. 7 is a sectional view of the interference connection between the upper tub member and the lower tub member taken along line 7—7 of FIG. 2.

Referring to FIGS. 2 and 7, the system for securing the upper tub 52 to the lower tub 54 may be described. A plurality of flexible tabs 70 are provided downwardly extending from the first wall portion 56 of the bottom peripheral edge of the upper tub member 52. These tabs are provided along the front and rear edge portions 64*a* and 64*b*. Each of the flexible tabs 70 have an engagement slot 72.

A plurality of engagement hooks 74 are provided outwardly extending from the lower tub member 54. The engagement hooks correspond in number and placement to the flexible tabs 70 such that when the upper tub member 52 and the lower tub member 54 are joined, the flexible tabs 70 and engagement hooks 74 align. Moreover, when the flange 62 is received into the U-shaped channel 60, the flexible tabs 70 are positioned to deflect over the engagement hooks 74 such that the engagement hooks 74 are captured in the engagement slots 72. In this fashion, the upper tub member 52 is securely connected to the lower tub member in a cost-effective manner without the need for any separate fasteners.

The two-piece tub 20 overcomes the problem of dimensional variation associated with large molded plastic parts. The tub is further advantageous in that it is quickly and easily assembled without the need for special fasteners because of the interference connection. Overall, the automatic washer and tub according to the invention is a novel improvement over previous automatic washers and tubs.

Although the present invention has been described with reference to specific embodiments, those of skill in the art will recognize that changes may be made thereto without departing from the scope and spirit of the invention as set forth in the appended claims.

We claim:

1. An automatic clothes washer comprising:

a wash tub defining a chamber adapted to receive a wash basket and the wash tub having an upper tub member with a first peripheral rim and a lower tub member with a second peripheral rim;

a connection between at least a portion of the first and second peripheral rims to secure together the upper and lower tub members to form the tub; and the upper tub member and lower tub member having at least one flexible tab with an engagement slot and the other of the upper tub member and the lower tub member has at least one engagement hook corresponding to the flexible tab and aligned with and extending through the engagement slot when the upper and lower tub members are connected by the interference connection to further secure together the upper and lower tub members.

2. An automatic clothes washer according to claim 1 wherein opposing side walls are provided on the first peripheral rim to form a channel, a flange having opposing sides corresponding to the side walls is provided on the second peripheral rim, the channel and flange being sized so that the flange can be received in the channel, and at least a portion of the flange and at least a portion of at least one of the side walls abut when the flange is received in the channel to form the connection.

3. An automatic clothes washer according to claim 2 wherein the first peripheral rim is further provided with a transverse flange extending between the side walls to form a U-shaped channel.

4. An automatic clothes washer according to claim 2 wherein the flange is resiliently flexible whereby when the flange abuts a side wall, the flange is flexed to form the connection.

5. An automatic clothes washer according to claim 2 wherein at least one of the opposing sides comprises at least one protrusion extending a sufficient distance to abut one of the side walls when the flange is received in the channel to form the interference connection.

6. An automatic clothes washer according to claim 5 wherein multiple protrusions extend from the opposing sides, alternating between the opposing sides.

7. An automatic clothes washer according to claim 6 wherein the protrusions are ribs integrally formed with the opposing sides.

8. An automatic clothes washer according to claim 2 wherein at least one of the side walls comprises at least one protrusion extending a sufficient distance to abut one of the sides when the flange is received in the channel to form the interference connection.

9. An automatic clothes washer according to claim 8 wherein multiple protrusions extend from the side walls, alternating between the side walls.

10. An automatic clothes washer according to claim 9 wherein the protrusions are ribs integrally formed with the side walls.

11. An automatic clothes washer according to claim 2 wherein the first peripheral rim is generally rectangular having opposing elongated portions and opposing end portions and the channel is provided on one of the elongated portions and end portions; and the second peripheral rim having opposing elongated portions and opposing end portions corresponding to the elongated portions and end portions of the first peripheral rim and the flange is provided on the one of the elongated portions and end portions of first peripheral corresponding to the one of the elongated portions and end portions on which the channel is provided.

12. An automatic clothes washer according to claim 2 wherein the channel has a width and the flange has a thickness and the width of the channel is at least twice the thickness of the flange so that the flange can be received in the channel.

13. An automatic clothes washer according to claim 2 further comprising a seal positioned in the channel to fluidly seal the upper tub member relative to the lower tub member when the upper and lower tub members are connected.

14. An automatic clothes washer according to claim 1 wherein the tub is elongated and has a horizontally oriented longitudinal axis.

15. An automatic clothes washer comprising:

a tub defining a chamber adapted to receive a wash basket, the tub comprising an upper tub member and a lower tub member, the upper tub member having a pan-like body with a first peripheral rim, the lower tub member having a pan-like body with a second peripheral rim corresponding to the first peripheral rim;

first and second spaced circumferential walls connected by a transverse circumferential wall are formed in the first peripheral rim to define a U-shaped channel;

a circumferential flange with opposing sides corresponding to the first and second circumferential walls is formed in the second peripheral wall and the circumferential flange sized to be received in the U-shaped channel; and at least one protrusion extending from one of the side wall and corresponding opposing side a sufficient distance to abut the other of the side wall and corresponding side to provide an interference connection between the upper tub member and the lower tub member.

16. An automatic clothes washer according to claim 15 wherein the flange is resiliently flexible whereby when the flange abuts either the first or second wall, the flange is resiliently flexed to form the interference connection.

17. An automatic clothes washer according to claim 16 wherein the at least one protrusion is a rib integrally formed with the one of the side wall and corresponding side.

18. An automatic clothes washer according to claim 17 further comprising a seal positioned in the U-shaped channel to fluidly seal the upper tub member relative to the lower tub member when the upper and lower tub members are connected.

19. An automatic clothes washer comprising:

an elongated tub having a horizontally orientated longitudinal axis, the tub comprising an upper tub member and a lower tub member, the upper tub member having a pan-like body with an upper peripheral rim, the lower tub member having a pan-like body with a second peripheral rim corresponding to the first peripheral rim;

first and second spaced circumferential walls connected by a transverse circumferential wall formed in the first peripheral rim to define a U-shaped channel;

a resilient flexible circumferential flange with opposing sides formed in the second peripheral rim and the circumferential flange sized to be received in the U-shaped channel; and multiple ribs extending from one of the first and second walls and the opposing sides a distance sufficient to contact the other of the first and second walls and the opposing sides and the multiple ribs being alternately disposed on the one of the first and second walls and opposing sides to thereby resiliently flex the flange to provide an interference connection to secure the upper tub member to the lower tub member.

20. A tub for an appliance comprising:

an upper tub member having a pan-like body with a first peripheral rim;

a lower tub member having a pan-like body with a second peripheral rim;

an interference connection between at least a portion of the first and second peripheral rims wherein the first peripheral rim includes a channel having a pair of side walls and the second peripheral rim includes a flange wherein the channel is sized to receive the flange which is received up into the channel; and at least one protrusion extending away from the flange a sufficient distance to abut one of the side walls when the flange is received in the channel to form the interference connection.

21. A tub for an appliance according to claim 20 wherein the flange is resiliently flexible whereby when the flange abuts the side walls, the flange is resiliently flexed to form the interference connection.

22. A tub for an appliance according to claim 20 further comprising a seal positioned in the channel to fluidly seal the upper tub member relative to the lower tub member when the upper and lower tub members are connected.

23. A tub for an appliance according to claim 22 wherein one of the upper tub member and lower tub member has at least one flexible tab with an engagement slot and the other of the upper tub member and the lower tub member has at least one engagement hook corresponding to the flexible tab and aligned with and extending through the engagement slot when the upper and lower tub members are connected by the interference connection to further secure together the upper and lower tub members.

* * * * *